US007032520B2

(12) United States Patent
Bart et al.

(10) Patent No.: US 7,032,520 B2
(45) Date of Patent: Apr. 25, 2006

(54) COMPACT PRINTING APPARATUS AND METHOD

(75) Inventors: Verhoest Bart, Niel (BE); De Ruyter Dirk, Deurne (BE); Verlinden Bart, Tongeren (BE)

(73) Assignee: Agfa-Gevaert N.V., Mortsel (BE)

( * ) Notice: Subject to any disclaimer, the term of this patent is extended or adjusted under 35 U.S.C. 154(b) by 43 days.

(21) Appl. No.: 10/918,968

(22) Filed: Aug. 16, 2004

(65) Prior Publication Data

US 2005/0022684 A1 Feb. 3, 2005

Related U.S. Application Data

(62) Division of application No. 09/781,861, filed on Feb. 12, 2001, now Pat. No. 6,782,822.

(60) Provisional application No. 60/188,947, filed on Mar. 13, 2000.

(30) Foreign Application Priority Data

Feb. 23, 2000 (EP) ..... 00200622

(51) Int. Cl.
*B41F 23/04* (2006.01)

(52) U.S. Cl. ..... 101/487; 101/424.1

(58) Field of Classification Search ..... 101/424.1, 101/487; 34/273, 523, 527, 611, 618, 240

See application file for complete search history.

(56) References Cited

U.S. PATENT DOCUMENTS

| | | | | |
|---|---|---|---|---|
| 2,775,934 | A | 1/1957 | Luehrs et al. | |
| 4,150,495 | A * | 4/1979 | Stern | 34/567 |
| 4,409,741 | A | 10/1983 | Bonomi | |
| 4,566,014 | A | 1/1986 | Paranjpe et al. | |
| 4,609,517 | A | 9/1986 | Cason et al. | |
| 5,257,070 | A | 10/1993 | Miller et al. | |
| 5,349,905 | A | 9/1994 | Taylor et al. | |
| 5,623,288 | A | 4/1997 | Thomas et al. | |
| 5,651,316 | A | 7/1997 | DeMoore et al. | |
| 5,749,567 | A | 5/1998 | DeAngelis | |
| 5,757,407 | A | 5/1998 | Rezanka | |
| 5,771,054 | A | 6/1998 | Dudek et al. | |
| 5,812,151 | A * | 9/1998 | Kishine et al. | 346/44 |

(Continued)

FOREIGN PATENT DOCUMENTS

EP 0 701 176 A1 3/1996

(Continued)

*Primary Examiner*—Ren Yan
(74) *Attorney, Agent, or Firm*—John A. Merecki; Robert A. Sabourin

(57) ABSTRACT

A printing apparatus (10) for printing an image on a receiving substrate (20) including ink application means (11) for imagewise applying liquid side of the receiving substrate; a drying section (12) for drying the receiving substrate after the ink application; transportation means (13,14,15) for transporting the receiving substrate along a path (30–36) past the ink application mean (11) and through the drying section (12); wherein the path (30–36) has a path section (30–36) between a first position (P1,P2) at the ink application means (11) and a second position (P3–P7) downstream the first position (P1,P2), the path section (30–36) having first (30) and second (32) substantially straight portions and a convex curve (31) between the first (30) and second (32) substantially straight portions.

4 Claims, 7 Drawing Sheets

U.S. PATENT DOCUMENTS

| | | | |
|---|---|---|---|
| 5,966,145 | A | 10/1999 | Miura et al. |
| 5,979,325 | A | 11/1999 | Mitze et al. |
| 6,079,330 | A | 6/2000 | Aoki et al. |
| 6,189,684 | B1 | 2/2001 | Greive |
| 6,322,069 | B1 | 11/2001 | Krucinski et al. |
| 6,467,410 | B1 | 10/2002 | Rasmussen et al. |
| 6,510,791 | B1 | 1/2003 | Hillebrand et al. |
| 6,511,172 | B1 | 1/2003 | Tanno et al. |

FOREIGN PATENT DOCUMENTS

| | | |
|---|---|---|
| EP | 00 20 0622 | 6/2000 |
| GB | 2 055 696 A | 3/1981 |

* cited by examiner

COMPACT PRINTING APPARATUS AND METHOD

CROSS-REFERENCE TO RELATED APPLICATIONS

This application is a Divisional application of patent application Ser. No. 09/781,861, filed Feb. 12, 2001, entitled "Compact Printing Apparatus and Method", now U.S. Pat. No. 6,782,822 which claims benefit of 60/188,947 filed Mar. 13, 2000.

FIELD OF THE INVENTION

The present invention relates to an apparatus and a method for printing images; the invention especially concerns the printer configuration. The invention is particularly suitable for ink-jet printing. The invention is particularly suitable for duplex printing and may also be applied to simplex printing.

BACKGROUND OF THE INVENTION

Whereas in simplex printing an image is printed on only a single side of a receiving substrate such as a sheet of paper, in duplex printing images are printed on both sides. When applying liquid ink to the receiving substrate in order to print the image, the wet receiving substrate first has to dry before it can be processed further; e.g. when printing on paper sheets, the printed sheet must be dry before the next sheet can be stacked on top of it.

U.S. Pat. No. 4,469,026 discloses a printer having a sheet fed and drum transport assembly. Ink is applied to a sheet while it is transported by the drum. Subsequently, the receiving substrate is detached from the drum and conveyed by a vacuum belt past a dryer.

U.S. Pat. No. 5,712,672 discloses a printer wherein sheets are transported by means of a vacuum belt past an ink-jet printhead and through a microwave dryer.

Patent application WO 99/11 551 discloses a printer wherein sheets are transported by a vacuum drum. A simplex printer has one vacuum drum, while a duplex printer uses two counter-rotating drums. In a duplex printer, a first image is printed on one side of a paper sheet while the sheet is on the first drum; then the paper is fed to the second drum so that the first printed image contacts the second drum, and a second image is printed on the opposite side of the paper. The printer can also be used to print on a continuous web instead of on separate sheets.

U.S. Pat. No. 4,609,517 discloses a printer having a device for flattening curled sheets subsequent to printing and at least partial drying thereof. The sheets are transported by a belt that has a straight portion along which a print module and a drying module are located.

U.S. Pat. No. 5,623,288 discloses several embodiments of a printer for making enlarged prints on a continuous web of receiving substrate. In a specific embodiment, the receiving substrate is passed around a first drive roller while ink is applied to the first side of the receiving substrate. The receiving substrate is then dried along a straight portion of its path. Subsequently, the receiving substrate is passed around a second drive roller while ink is applied to the second side of the receiving substrate, opposite to the first side. Then, the receiving substrate is dried again, along another straight portion of its path.

U.S. Pat. No. 5,966,145 discloses a printer for textile printing on a cloth. A thin endless metallic belt transports the cloth past two printing units and a drying unit in-between that are all located along a straight portion of the belt. The cloth is separated from the belt and dried again by a post-drying unit located at another straight portion of the cloth path.

U.S. Pat. No. 4,566,014 discloses a sheet printer wherein the gap between successive sheets is adjusted for optimal drying of the sheets. The printer has a printing unit that is located along a straight portion of the sheet path. After printing, the sheet is dried in a drying unit along a straight portion of a first belt, a portion of a drum and a straight portion of a second belt. Optionally, the printed sheet may be re-fed to the printing unit and the drying unit for duplex printing.

A disadvantage of the printers described above is that they are not compact. This is especially the case in high speed printing, because at high speed the processing operations in the printer, such as drying the receiving substrate, require quite some space.

OBJECTS OF THE INVENTION

It is an object of the present invention to provide a printing apparatus that has a compact configuration.

It is an object of the present invention to provide a method for producing an image on a receiving substrate by means of a printer, so that the printer is compact.

Definitions of Terms

A "receiving substrate" may be a separate sheet or it may be a continuous web; it may be made of paper, of polyethylene coated paper, of plastic, of white poly(ethylene terephtalate), of another material as known in the art; it may be a laminate of two or more materials; it may comprise one or more special layers such as an image-receiving layer; it may be transparent or opaque. A receiving substrate has two sides opposite to each other; in simplex printing an image is printed on only a single side, in duplex printing images are printed on both sides.

"Liquid ink" is ink that is in the liquid state of aggregation when it is applied to the receiving substrate. Thus, liquid ink includes e.g. the following types of ink, known in the art: water based ink, oil based ink, solvent based ink, hot melt ink. Whereas the first three types of ink are liquid at room temperature, hot melt ink is solid at room temperature and is applied at a temperature higher than room temperature.

A "touch-dry" receiving substrate is a receiving substrate, or a portion thereof, that is substantially dry so that, after printing, mutual contact of the fresh prints is possible without causing smudges. Usually, after printing, separate sheets are stacked on top of each other, while a continuous web may be wound onto a roll or cut into sheets that are stacked, so that portions of the printed web contact each other.

A "drying section" is a section, or portion, of the apparatus wherein the receiving substrate, still containing wet ink originating from the ink application, is subjected to a drying process so that it becomes touch-dry. The drying process may be different, depending on the type of ink; e.g.:

- for water based ink, the drying process involves absorption and penetration of the ink in the receiving substrate and evaporation of water from the ink;
- for oil based ink, the drying process involves absorption and penetration;
- for solvent based ink, the drying process primarily involves evaporation;

for hot melt ink, the drying process involves solidification of the ink.

The drying process can occur in a 'passive' way, or in an 'active' way by using drying means in order to accelerate the drying process. For water based ink, for instance, natural air drying is a 'passive' way of drying, whereas 'active' drying involves using drying means such as infrared lamps, microwave energy applicators, hot air applicators, or other drying means as known in the art; a combination of passive and active drying may also be used.

"Drying means" are discussed in the definition of a "drying section" above.

A "convex curve" along which a printed receiving substrate is transported is a curve that has its centres of curvature 'CC' further away from the printed side 'PR' of the receiving substrate than from the other side 'OS' of the receiving substrate; i.e. along a straight line starting at a centre of curvature CC of the curve and intersecting the receiving substrate, the order wherein the sides are encountered is: CC, OS, PR. The printed side PR of the receiving substrate is that side which was printed last; it may still contain wet ink. FIG. 1 shows a convex curve 31 (ink is applied last by ink application means 11) and a concave, i.e. non-convex curve 59 (ink is applied last by ink application means 21). FIG. 1 is further discussed below. A convex curve may be a circular curve or a non-circular curve. A circular curve has one centre of curvature, viz. the centre of the circle of which the curve forms a part. For a non-circular curve, each point P of the curve has a corresponding centre of curvature CC which is defined as the limiting position of the point of intersection of the normals at P and at a neighbouring point Q, as Q is made to approach P along the curve (see e.g. "Marks' Standard Handbook for Mechanical Engineers", Baumeister et. al, ISBN 0-07-004123-7, McGraw-Hill, eighth edition, page 2–45). A "concave curve" along which a printed receiving substrate is transported is a curve that has its centres of curvature CC closer to the printed side PR of the receiving substrate than to the other side OS of the receiving substrate.

The "angle covered by a curve" is the angle between the normals at the endpoints of the curve. For a circular curve, this angle can also be calculated as: the length of the curve, divided by the radius of the circle of which the curve forms a portion, multiplied by 180°/pi to convert the angle from radians to degrees.

A "convex arc" means in this document a small convex curve, covering an angle of e.g. 5° or less.

SUMMARY OF THE INVENTION

The above mentioned objects are realised by a printing apparatus having the specific features defined in independent claims 1 and 2 and by a method having the steps defined in independent claims 11 and 12. Specific features for preferred embodiments of the invention are set out in the dependent claims.

A printing apparatus—also called a printer—as claimed provides a compact configuration, especially for high speed printers where the processing operations, such as applying the ink, drying the receiving substrate, transporting it, require quite some space since the operations need a given time. The path of the receiving substrate in a printer in accordance with the invention is such that, for a given floor space and a given height of the printer, a large path length is available for the required processing operations.

FIG. 1 shows a first embodiment of a duplex printer 10 in accordance with the invention. A receiving substrate 20 is taken from an input stack 61 of sheets and conveyed by input rollers 62 and roller 16 to belt 14. Belt 14 is guided by pulleys 13 and moves clockwise, in the sense of arrow A1; it first transports the receiving substrate 20 past ink application means 11 that applies liquid ink to one side of the receiving substrate 20 and so prints a first image. The receiving substrate is then transported by belt 14 through a drying section 12 where the receiving substrate becomes touch-dry. Subsequently the receiving substrate 20 is transferred to a second belt 24 in take-over section 25, so that the side of the receiving substrate that contains the first image contacts belt 24. Belt 24 is guided by pulleys 23 and moves counterclockwise, in the sense of arrow A2; i.e. belts 14 and 24 are counterrotating. Belt 24 transports the receiving substrate past ink application means 21 that prints a second image on the other side of the receiving substrate, so that both sides of the receiving substrate now contain a printed image. The receiving substrate is further transported by belt 24 through drying section 12 in order to become touch-dry. Finally, the receiving substrate is transported by roller 26 and conveyed by output rollers 63 to output stack 64.

In the embodiment shown in FIG. 1, belt 14 transports receiving substrate 20 along a substantially polygonal path 30,31,32,33,34,35,36, abbreviated as 30–36, past ink application means 11 and through drying section 12. Path 30–36 comprises, in the sense of arrow A1:

- a substantially straight portion 30, consisting of substantially straight portions 30*a* up to position P1, 30*b* between positions P1 and P2 and 30*c* beyond position P2;
- a convex curve 31;
- a substantially straight portion 32, consisting of substantially straight portions 32*a* up to position P3 and 32*b* beyond position P3;
- a convex curve 33;
- a substantially straight portion 34, consisting of substantially straight portions 34a up to position P4 and 34*b* beyond position P4;
- a convex curve 35;
- a substantially straight portion 36, consisting of substantially straight portions 36*a* up to position P6 and 36*b* beyond position P6.

Positions P1–P7 along path 30–36 are located as follows: P1 and P2 at the ink application means 11, P3 and P4 in the drying section 12, P5, P6 and P7 in the take-over section 25.

"Downstream" is the term that is used to indicate the location of P1–P7 relative to each other, in the transport direction of the receiving substrate, i.e. with respect to the sense of arrow A1 in FIG. 1: position P7 is located downstream position P6, P6 is downstream P5, . . . , P2 is downstream P1. Conversely, P1 is "upstream" P2, etc.

The path 30–36 of the receiving substrate 20 in the embodiment shown in FIG. 1 is substantially polygonal: it is a polygon with rounded edges. The rounded edges, i.e. convex curves 31, 33, 35, may be realised by guiding belt 14 around pulleys 13. A substantially straight portion such as portions 30, 32, 34, 36 may be realised by tightening belt 14 between two pulleys 13. An advantage of a substantially polygonal path is that a large path length is available for the required processing operations, so that the printer may be compact. In fact, for a given floor space and printer height, a circular drum as disclosed in WO 99/11 551 only provides the circumference of the circle as available path length for processing operations. A substantially polygonal path, on the other hand, provides the perimeter of the rounded polygon as available path length, which may be considerably larger than the circle circumference of a circular drum if the polygon is a circumscribed polygon of the circle. The circumscribed polygon may fit within the same given dimensions of floor space width, floor space length and printer height as the corresponding circular drum, while the circumscribed polygon provides a larger available path length than the drum. In a preferred embodiment, the path is substantially rectangular. A substantially rectangular path that has dimensions that exactly fit within the given width, length and height dimensions theoretically provides the maximum available path length for the given dimensions.

However, the available path length is not the only important issue; for duplex printing, two paths and the means to carry out the required processing operations have to fit within the given dimensions. Path 50–59 in FIG. 1 includes a portion 50–58 of a substantially polygonal path, realised by belt 24 moving in the sense of arrow A2, and it includes a semicircle 59, realised by roller 26. A portion of a polygonal path, such as portion 50–58, also provides the advantage of a large available path length (remark: the even reference numbers 50,52,54,56 and 58 indicate substantially straight portions, while the odd reference signs 51,53,55 and 57 indicate convex curves). Moreover, as is clear from FIG. 1, the combination of paths 30–36 and 50–59 through respectively the upper half and the lower half of duplex printer 10 provides a compact arrangement and a large available path length for the processing operations required to print an image on both sides of the receiving substrate 20.

FIGS. 3 to 7 show other embodiments in accordance with the invention. In FIG. 3, belts 14 and 24 have a substantially triangular shape, while in FIGS. 4 to 7 the path of the receiving substrate 20 includes portions of rounded rectangles.

Another advantage of the invention is flexibility: it is easy, e.g. during the design phase of the printer, to adapt the path of the receiving substrate. In fact, a vertex of the polygon portion associated with a portion of a substantially polygonal path may easily be displaced, e.g. by displacing (see FIG. 1) a pulley 13 that guides belt 14. Moreover, because of this flexibility, the printing apparatus may be made even more compact since the path can easily be adapted to make room for a specific portion of the printing apparatus.

Yet another advantage of the invention is that the processing operations may be carried out along substantially straight portions of the path. This simplifies construction of the means that are used to carry out these operations; it is also particularly advantageous for ink application, as is discussed in detail below.

The advantages discussed above are provided by a path of the receiving substrate that has a path section that includes a number of substantially straight portions and curves between these substantially straight portions, such as substantially straight portions 30,32,34,36 and curves 31,33,35 in path 30–36 in FIG. 1. Preferably, the curves are convex curves since the printing apparatus applies liquid ink, so that the printed side of a receiving substrate preferably does not touch any part of the apparatus before it is touch-dry. However, the path of the receiving substrate may also include concave curves; see e.g. FIG. 6 wherein the path between positions P2 and P3 includes convex curve 31 and concave curve 42, both located between substantially straight portion 30*c* and substantially straight portion 32*a* (remark: concave curve 42 is further discussed hereafter, at the discussion of transfer from one belt to another one).

In order to provide the advantages mentioned above, the length of the substantially straight portions is preferably larger than the length of the convex curves. Therefore, in a preferred embodiment, with $L_{STRAIGHT}$ the sum of the lengths of the substantially straight portions in the concerned path section and with $L_{CURVES}$ the sum of the lengths of the convex curves in the concerned path section, $L_{STRAIGHT}>k*L_{CURVES}$ with k>1, preferably k>2, more preferably k>3 and most preferably k>4. Preferably, the concerned path section comprises at least one large convex curve, more preferably at least two large convex curves, wherein a large convex curve is a curve covering an angle not smaller than 10°, preferably larger than 20°, more preferably larger than 30°, still more preferably larger than 45° and most preferably larger than 60°.

In a preferred embodiment of the invention, the path of the receiving substrate 20 has a path section that is delimited by a first position at the ink application means 11 and by a second position downstream the first position, so that the path section includes a convex curve between two substantially straight portions. For instance path 30–36 in FIG. 1 has a path section 30*b*,30*c*,31,32*a* that is delimited by positions P1 and P3 downstream P1 and this path section includes a first substantially straight portion 30*b* & 30*c*, a second substantially straight portion 32*a*, and a convex curve 31 between the first and second substantially straight portions (remark: the meaning of "&" in substantially straight portion 30*b* & 30*c* is that the portion is composed of adjoining sub-portions 30*b* and 30*c*). Some other examples of this preferred embodiment are: in FIG. 3: path section 30*c*,31,32 between position P2 at ink application means 11 and position P3 which is in the drying section (not shown in FIG. 3); in FIG. 4: path section 30*b*,30*c*,31,32*a* between position P1 at ink application means 11 and position P3 in the drying section (not shown in FIG. 4).

In another preferred embodiment of the invention, the path of the receiving substrate 20 has a path section that is delimited by a first position at the ink application means 11 and by a second position downstream the first position, so that the path section includes three substantially straight portions and two convex curves, so that each convex curve is between two substantially straight portions. Some examples are: in FIG. 1: path section 30*c*,31,32*a*,32*b*,33,34*a* between P2 and P4 which is in the drying section; in FIG. 5: path section 30*b*,30*c*,31,32*a*,32*b*,33,34*a* between P1 and P4 which is in the drying section (not shown in FIG. 5).

In yet another preferred embodiment of the invention, the path of the receiving substrate 20 has a path section that is delimited by a first position at the ink application means 11 and by a second position downstream the first position, so that the path section includes four substantially straight portions and three convex curves, so that each convex curve is between two substantially straight portions. Some examples are: in FIG. 1: path section 30*c*,31,32*a*,32*b*,33,34*a*,34*b*,35,36*a*,36*b* between P2 and P7 which is in take-over section 25; in FIG. 6: path section 30*c*,31,41,42,32*a*,32*b*,33,34*a*,34*b*,35,36*a*,36*b* between P2 and P7 which is in take-over section 25.

In still another preferred embodiment of the invention, the path of the receiving substrate 20 has a path section that is delimited by a first position that is in the drying section instead of at the ink application means, and by a second position downstream the first position, so that the path section includes either two substantially straight portions and a single convex curve, or three substantially straight portions and two convex curves, or four substantially straight portions and three convex curves, so that each convex curve is between two substantially straight portions.

An example is, in FIG. 1, path section 32*b*,33,34*a*,34*b*,35, 36*a* between P3 in drying section 12 and P6 in take-over section 25.

In the embodiments discussed above, the second point that delimits the path section may be in the drying section; it may be in the take-over section (for a duplex printer); it may be both in the drying section and in the take-over section (for a duplex printer).

The path section may also have more convex curves than illustrated by the examples discussed above.

Preferably, the receiving substrate 20 is transported along its path through the drying section by means of a belt, most preferably by a vacuum belt. In a preferred embodiment of the invention, the belt through the drying section is an endless belt that is guided by at least two pulleys, preferably by at least three pulleys, most preferably by at least four pulleys (see also FIGS. 1 to 7).

The invention may be applied to duplex printers. FIGS. 1 to 5 all diagrammatically show a duplex printer. In a duplex printer, either the first path for printing a first side of the receiving substrate (path 30–36 in FIG. 1) or the second path for printing the second side, opposite to the first side, of the receiving substrate (path 50–59 in FIG. 1), or, which is preferred, both the first and the second path are in accordance with the invention.

The invention may also be applied to simplex printers. In FIG. 1, a diagrammatic side view of a-simplex-printer may be obtained by deleting the upper half of the printer and by directly conveying the receiving substrate 20, for instance by an extra roller, from input rollers 62 to ink application means 21. FIG. 7 shows a simplex printer that can also be used for duplex printing.

In a method in accordance with the invention, a receiving substrate, that contains an image printed with liquid ink, is partly dried, is then transported along a convex curve, such as curve 33 in FIG. 1, and is subsequently further dried.

Preferred embodiments of a method in accordance with the invention may include features of a printing apparatus—as claimed or as described above or below—in accordance with the invention, and vice versa. For instance, a method in accordance with the invention may include the steps of imagewise applying liquid ink to a first side of the receiving substrate, and subsequently transporting the receiving substrate along three substantially straight portions and two convex curves, so that each convex curve is between two substantially straight portions.

Further advantages and embodiments of the present invention will become apparent from the following description and drawings.

BRIEF DESCRIPTION OF THE DRAWINGS

The invention is described with reference to the accompanying drawings without the intention to limit the invention thereto, and which diagrammatically show a side view of embodiments of the invention.

DETAILED DESCRIPTION OF THE INVENTION

Figure 1:
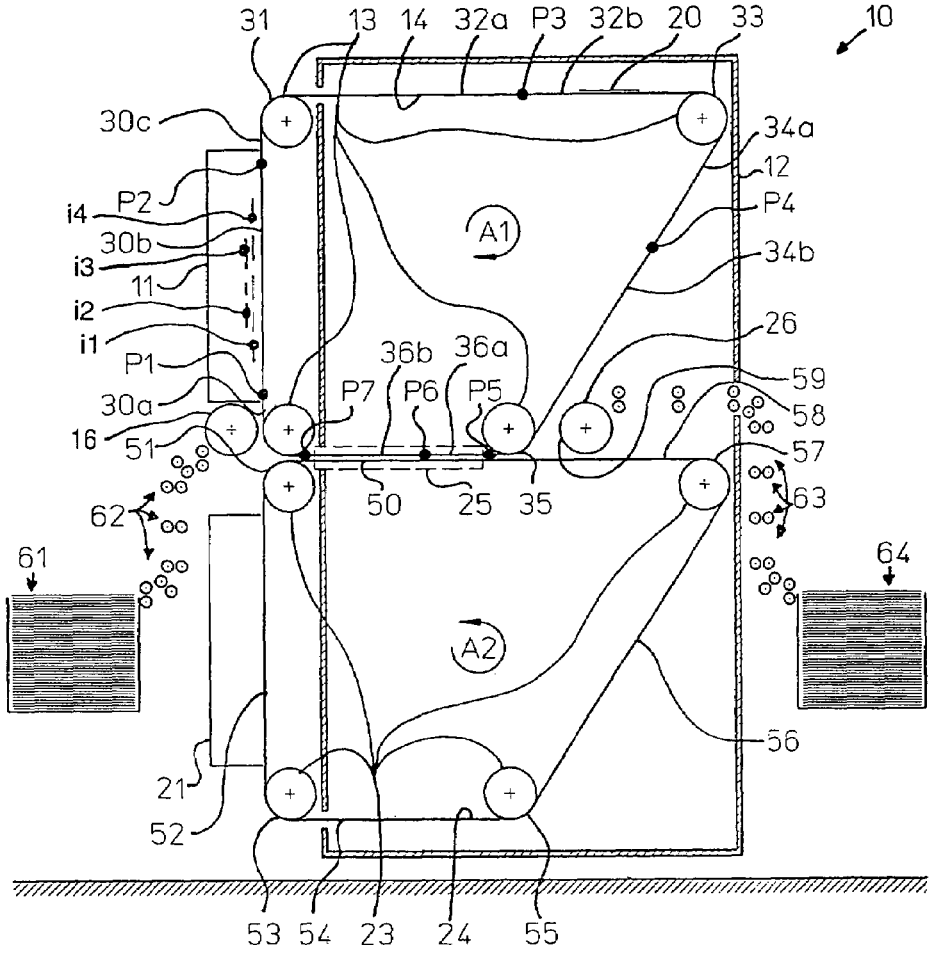
FIG. 1 shows a first embodiment.

The present invention may be applied to a carriage-type printer or to a page-width type printer. In a carriage-type printer, the printhead is attached to a carriage which is reciprocated to print a swath of information at a time. After the swath is printed, the receiving substrate is stepped a distance equal to the height of the printed swath or a portion thereof, and then the next swath is printed, adjacent to or overlapping with the previous swath. In a page-width printer, the printhead is usually stationary and has a length that is substantially equal to the width or length of the receiving substrate. During the printing process, the receiving substrate is continually moved past the page-width printhead in a direction substantially normal to the printhead length. A page-width ink-jet printer is described, for instance, in patent U.S. Pat. No. 5,192,959. As mentioned, the printhead length is substantially equal to the width or length of the receiving substrate. The printhead length may be slightly smaller than the width or length of the receiving substrate, thus leaving a non-printed border at one or at both sides of the receiving substrate. Alternatively, the printhead length may be equal to the width or length of the receiving substrate or slightly larger, so that no non-printed border is left; excess ink not applied to the receiving substrate may be collected.

Preferably, the invention is applied to a colour printer.

Preferably, a printing apparatus in accordance with the invention applies liquid ink to the receiving substrate. In a preferred embodiment, the printing apparatus is an ink-jet printer. The invention may also be applied to other types of printers known in the art, such as an ink transfer device as disclosed in U.S. Pat. No. 5,745,128. In this device, the ink transfer to the receiving substrate is driven by a viscosity change in the ink. After passing through the ink transfer area, the ink on the receiving substrate may still be wet, and it may be fixed to the receiving substrate in a post treatment area, for instance by heating.

In an embodiment of the invention, transporting the receiving substrate along a polygonal path or a portion thereof is carried out by transportation means 13–15,23,24, 27 that may be transportation means as known in the art and that preferably include an electrostatic belt, more preferably mechanical gripping means, most preferably a vacuum belt. An electrostatic belt is described in EP-A-0 866 381. In the case of mechanical gripping means, reference signs 14 and 24 in FIG. 1 may refer to chains instead of belts; the gripping means may be coupled to these chains and they may grip the receiving substrate at its sides that are substantially parallel to the chains. A vacuum belt and a vacuum applicator are described in U.S. Pat. No. 5,712,672; a vacuum applicator generates the vacuum whereby the receiving substrate is adhered to the vacuum belt. Belts 14 and 24 in FIG. 1 may be vacuum belts; the corresponding vacuum applicators are not shown.

The invention is especially useful for high speed printing; in a preferred embodiment the receiving substrate is transported by the transportation means 13–15,23,24,27 at a speed not smaller than 0.05 m/sec, preferably larger than 0.1 m/sec, more preferably larger than 0.2 m/sec and most preferably larger than 0.4 m/sec.

As mentioned hereinbefore, in the drying section the drying process can occur in a 'passive' way, in an 'active' way by using drying means, or by a combination of both. Especially in case of passive drying, the drying section is not clearly delimited in the printer by specific parts, such as boundary walls. In fact, in case of passive drying, the drying section starts at the position where all ink is applied to a side of the receiving substrate, i.e. at position P2 in FIG. 1, the drying section includes the path of the receiving substrate from this position on, and it ends at the position where the receiving substrate is touch-dry or it may extend even further. In a preferred embodiment, the drying section 12 is clearly delimited in the printer, such as drying section 12 in FIG. 1; preferably the drying section has 'active' drying means and more preferably these drying means, for instance hot air application means, produce a higher temperature in the drying section than in the printing section of the printer—the printing section is the section that includes the ink application means 11.

Drying the receiving substrate is often a time-consuming step. After ink application, the drying time that is required to obtain a touch-dry receiving substrate may for instance be of the order of 5 seconds when printing on paper with a water based ink in an ink-jet printer using specific drying means. At a speed of 0.5 m/sec of the receiving substrate, this means that a distance of 0.5*5=2.5 m is required to obtain a touch-dry receiving substrate. The drying time of e.g. 5 seconds is mainly determined by the amount of liquid, originating from the applied ink, that has to be evacuated from the receiving substrate by evaporation and by the drying conditions, such as the drying temperature. The drying temperature is limited for instance by the maximum power applied to the active drying means and by the maximum allowable temperature of the receiving substrate. Because of such limitations, drying is often time-consuming.

The invention is especially useful if a large drying time is required. In a preferred embodiment, the receiving substrate is paper. Preferably, water based ink is applied, which can be used without special measures in an office-like environment, whereas, for solvent based inks, fumes may be released during the drying process. However, the invention is not limited to large drying times: not only drying requires space, but also the other processing operations, such as transferring the receiving substrate from the path where the first side of the receiving substrate is printed to the path where the opposite side is printed, in a duplex printer, such as aligning the receiving substrate, which is discussed hereafter, etc. Therefore, also in case of smaller drying times of the order of 1 second and less, the compactness of a printing apparatus in accordance with the invention is a substantial advantage.

Figure 2:
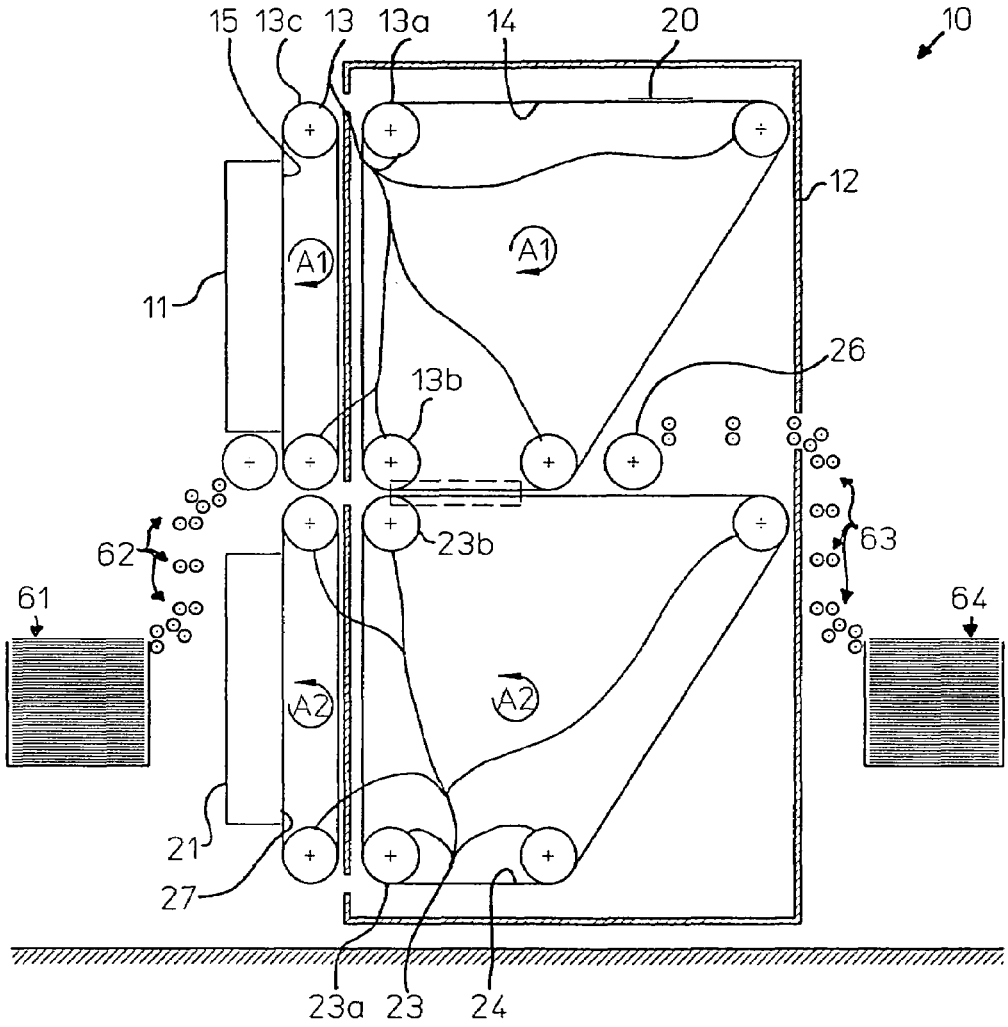
FIG. 2 shows another version of this first embodiment.

FIG. 2 shows another version of the first embodiment of FIG. 1; the receiving substrate follows the same path in FIG. 2 as in FIG. 1. In order to keep the drawing clear and readable, the reference signs occurring in FIG. 1 are omitted in FIG. 2 for positions P1–P7, for take-over section 25 and for the first path 30–36 and the second path 50–59 of the receiving substrate 20. The difference between the embodiments shown in FIG. 1 and FIG. 2 concerns the transportation means that transport the receiving substrate 20 past the ink application means and through the drying section. In the embodiment shown in FIG. 2, the transportation means 13,14 of FIG. 1 are 'split' into printing-transportation means 13,15 (i.e. belt 15 and two pulleys 13) past ink application means 11 and drying-transportation means 13,14 through drying section 12 (i.e. belt 14 and four pulleys 13 including pulleys 13*a* and 13*b* that are additional with respect to FIG. 1). 'Splitting' the transportation means 13,14 shown in FIG. 1 into printing-transportation means 13,15 and drying-transportation means 13,14 shown in FIG. 2 involves that the printer has first driving means for driving the printing-transportation means 13,15 and second driving means for driving the drying-transportation means 13,14; the first and second driving means each may include components such as a motor, coupling means, transmission means such as gears, timing belts; the 'splitting' implies that the first driving means are different from the second driving means, i.e. they have at least one different component. An advantage of the embodiment shown in FIG. 2 is that the printing-transportation means 13,15 may be constructed taking into account requirements of high precision, as is generally demanded by the ink application operation, while the drying-transportation means 13,14 may be constructed for a higher temperature in the drying section 12. A higher temperature involves for instance thermal expansion of the transportation means through the drying section, which may adversely affect the accuracy of the ink application in case of a single belt 14 as shown in FIG. 1.

In a duplex printer as shown in FIG. 1, preferably both the first transportation means 13,14 are split and the second transportation means 23,24 are split. FIG. 2 shows printing-transportation means 13,15 and drying-transportation means 13,14 for respectively transporting the receiving substrate 20 past ink application means 11 and through drying section 12, and it shows printing-transportation means 23,27 and drying-transportation means 23,24 for respectively transporting the receiving substrate 20 past ink application means 21 and through drying section 12 (remark: in FIG. 2, the printing-transportation means 23,27 include belt 27 and two pulleys 23, while the drying-transportation means 23,24 include belt 24 and four pulleys 23 including pulleys 23*a* and 23*b* that are additional with respect to FIG. 1).

Figure 5:
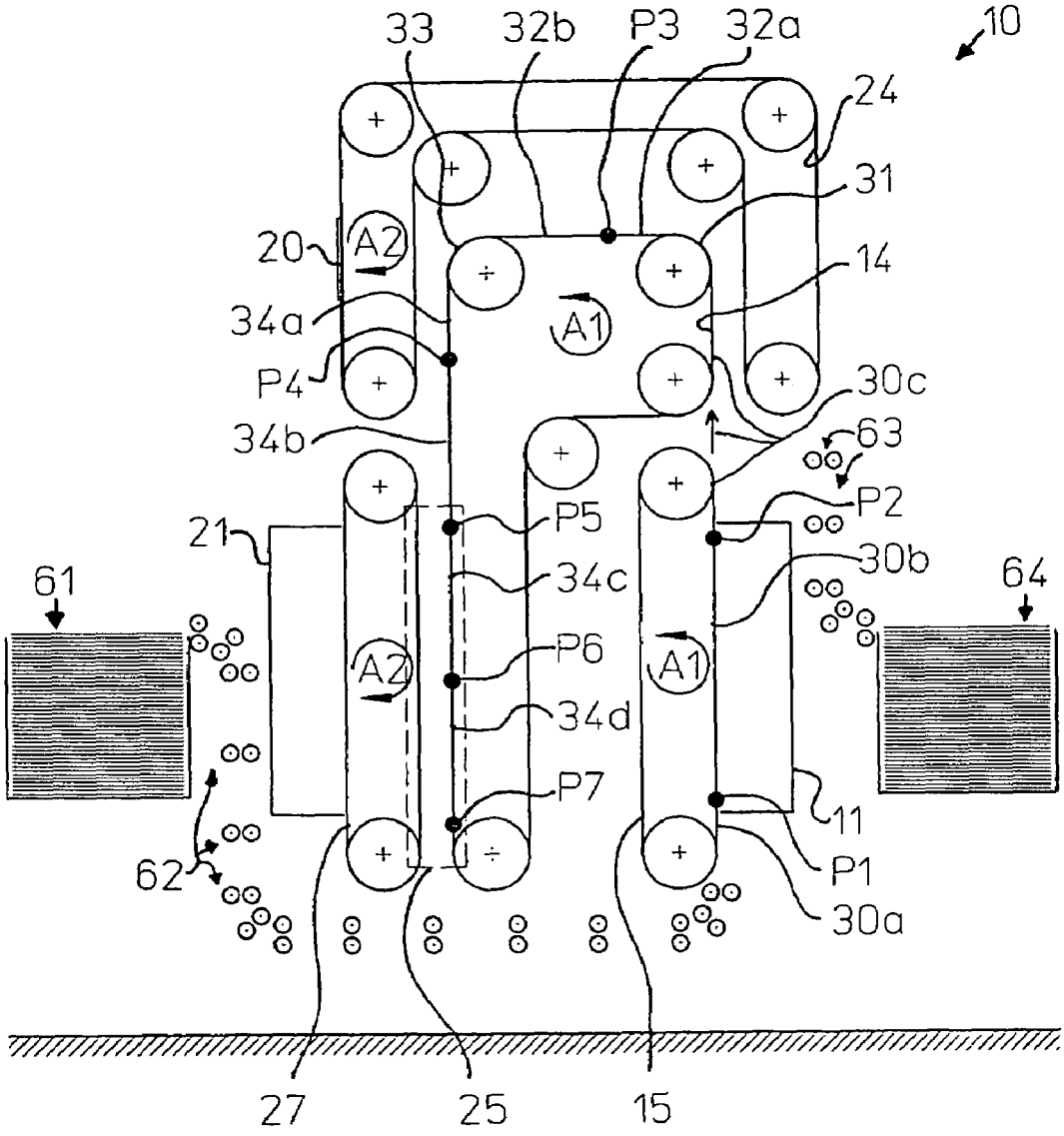
Figure 6:
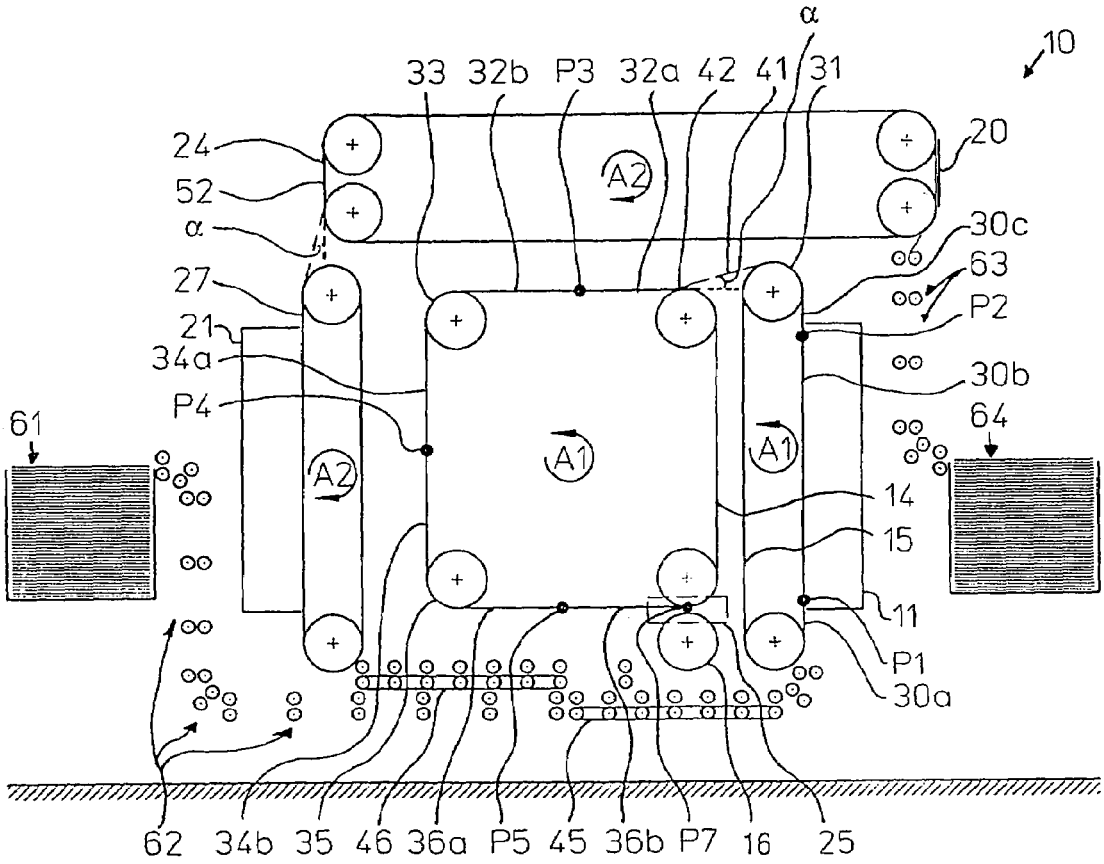
Figure 7:
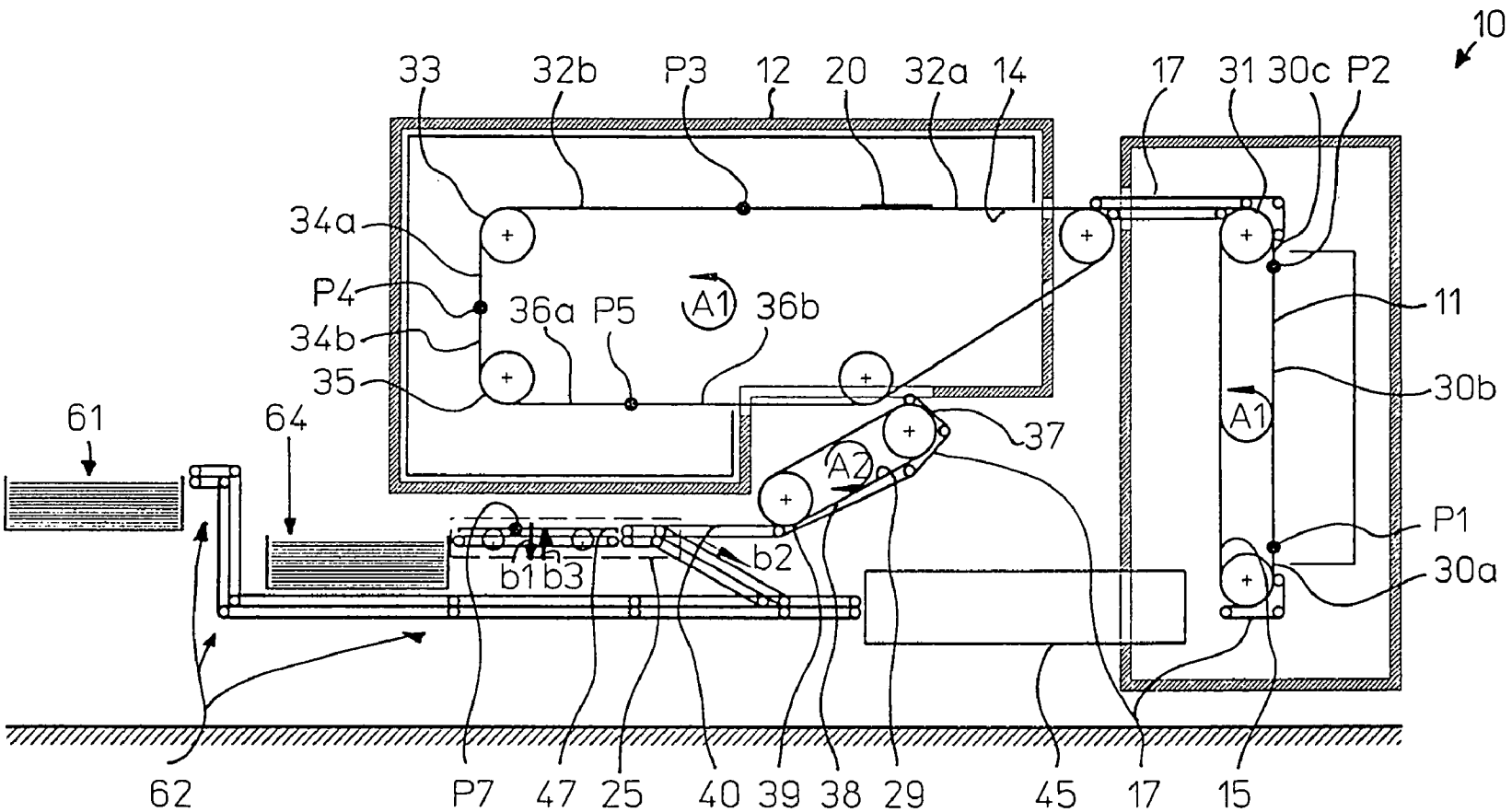

FIGS. 3 to 7 show other printer configurations in accordance with the invention. In order to keep these drawings clear and readable, in comparison with FIG. 1 the reference signs are omitted in FIGS. 3 to 7 for pulleys 13 and 23 and for the second path 50–59 of the receiving substrate 20 (remark: there is no such second path in the configuration of FIG. 7). Moreover, in FIGS. 3 to 6 no drying section 12 is indicated. Further, the location of the positions P1–P7 with respect to the substantially straight portions and curves 30–36, as well as the number of positions P1–P7 and the number of portions and curves 30–36 may be different with respect to FIG. 1, because of the different shape of path 30–36 in the embodiments shown in FIGS. 3 to 7. In FIG. 7, the first path of the receiving substrate 20 between the ink application means 11 and the take-over section 25 is indicated by reference signs 30–40.

Figure 3:
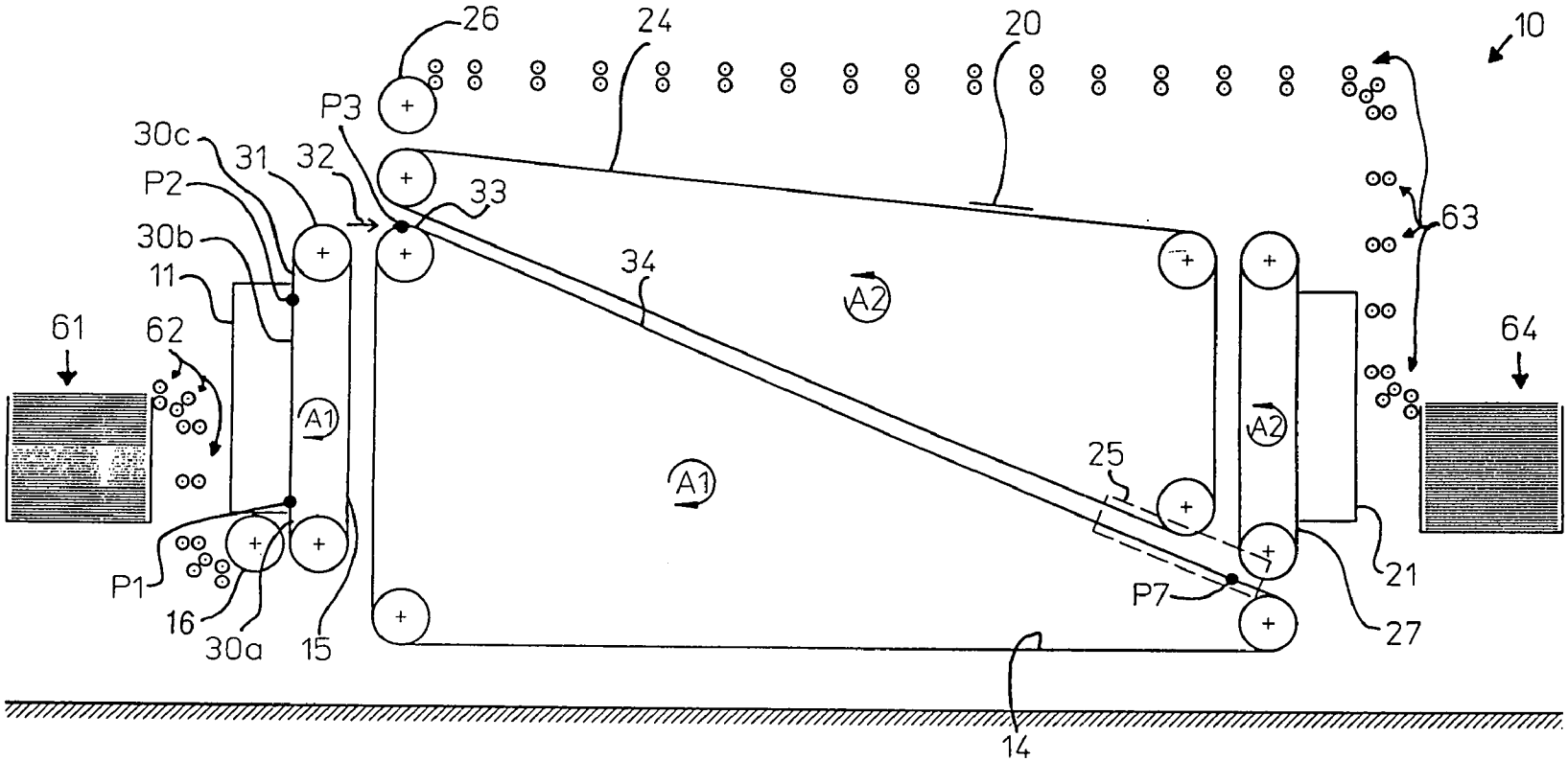
FIGS. 3 to 7 each show another embodiment.

In FIG. 3, no positions P4, P5 and P6 are indicated. Preferably, a drying section having active drying means encompasses position P3 and drying-transportation belt 24. The path of the receiving substrate 20 in the embodiment of FIG. 3 is as follows (arrows A1 and A2 again indicating the sense of movement of the belts): a receiving substrate is taken from input stack 61, conveyed by input rollers 62 and roller 16 to belt 15, past first ink application means 11, transferred—along a substantially straight portion of the path indicated by arrow 32—from belt 15 to belt 14, transferred in take-over section 25 to belt 27, past second ink application means 21, transferred to belt 24, conveyed by roller 26 and output rollers 63 to output stack 64.

Figure 4:
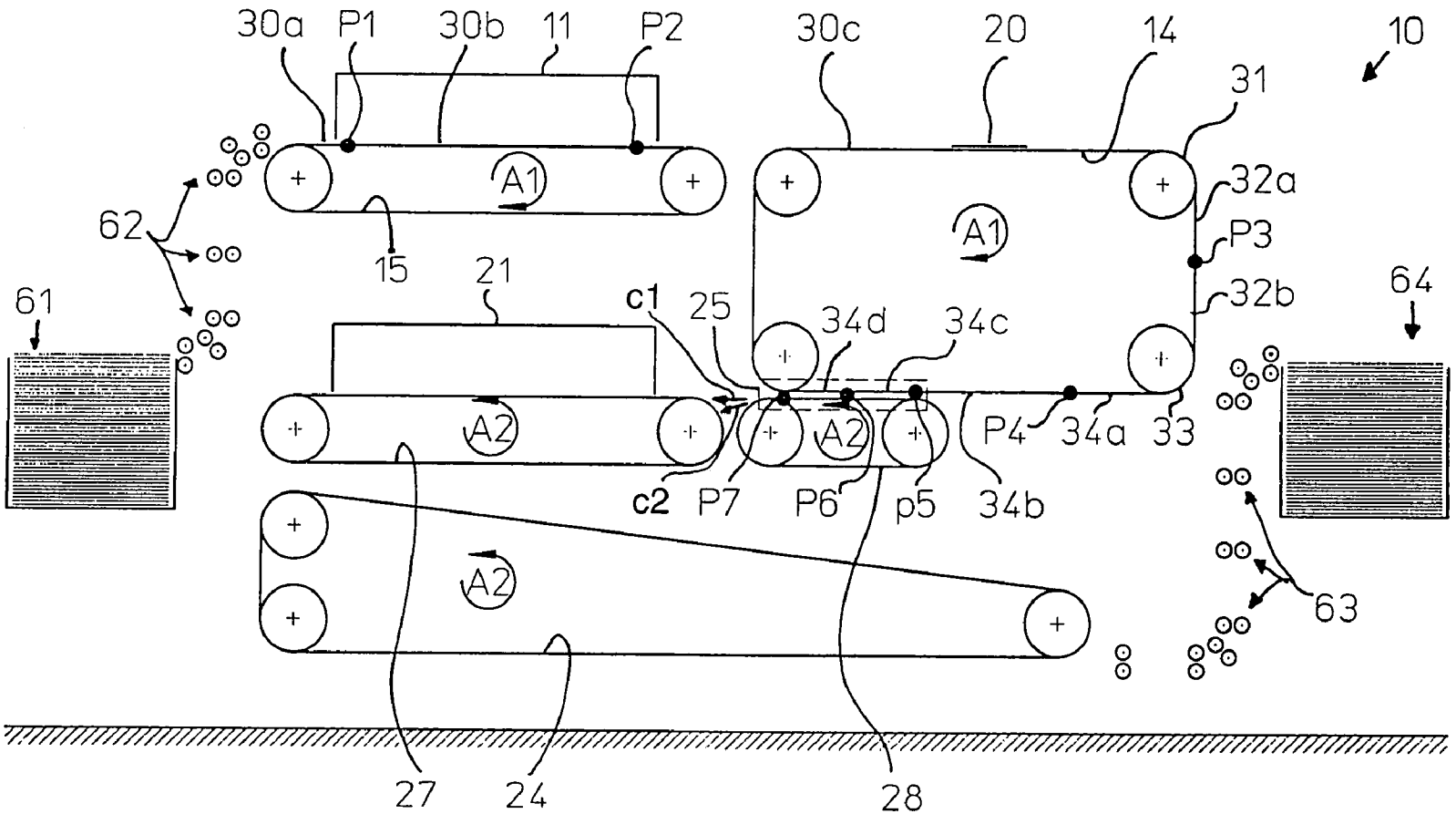

In FIG. 4, the receiving substrate is transferred in take-over section 25 from belt 14 to belt 28, which is an additional belt with respect to FIG. 1. FIG. 1 only shows a single drying section 12 that is used to dry the receiving substrate both after ink application by ink application means 11 and after ink application by ink application means 21. In another preferred embodiment, the printer may have two different drying sections, each of which may have active drying means. In the embodiment of FIG. 4 for instance, a first drying section may encompass drying-transportation belt 14 and possibly also belt 28, while a second, different drying section may encompass drying-transportation belt 24. The path of the receiving substrate 20 in this embodiment is as follows: input stack 61; input rollers 62; belt 15, past first ink application means 11; belt 14; belt 28; belt 27, past second ink application means 21; belt 24; output rollers 63; output stack 64.

In FIG. 5, the receiving substrate is transferred in take-over section 25 from drying-transportation belt 14 to printing-transportation belt 27. The path of the receiving substrate 20 in the embodiment of FIG. 5 is as follows: input stack 61; input rollers 62; belt 15, past first ink application means 11; belt 14; take-over section 25; belt 27, past second ink application means 21; belt 24; output rollers 63; output stack 64.

In FIG. 6, the path of the receiving substrate 20 includes, at the transfer from printing-transportation belt 15 to drying-transportation belt 14, a portion 41 and a concave curve 42. Portion 41 may be a substantially straight portion, a convex curve, a concave curve. Portion 41 and concave curve 42 are discussed below, at the discussion of transfer from one belt to another one. Alignment systems 45 and 46 serve to align the receiving substrate before ink is applied by ink application means 11 respectively 21 and are discussed further below, at the discussion of the take-over section. The path of the receiving substrate 20 in the embodiment of FIG. 6 is as follows: input stack 61; input rollers 62; alignment system 45; belt 15, past first ink application means 11; drying-transportation belt 14; take-over section 25; roller 16; alignment system 46; belt 27, past second ink application means 21; drying-transportation belt 24; output rollers 63; output stack 64.

FIG. 7 shows a simplex printer that can also be used for duplex printing. Only one ink application means 11 is present. Moreover, the take-over section 25 is of another type than the one of the embodiments of FIGS. 1 to 6. For simplex printing, the printed and dried receiving substrate 20 is directly transported by belt 38 and over platform 47 to-output stack 64. For duplex printing, transportation of the receiving substrate is stopped at platform 47. Platform 47, holding receiving substrate 20, is lowered in the direction of arrow b1 so that the receiving substrate can be transported in the direction of arrow b2 to the alignment system 45. The receiving substrate is now transported for the second time past ink application means 11, where an image is printed on its second side, and it is transported again through drying section 12. In the mean time, platform 47 is raised in the direction of arrow b3 so that it again occupies its original position, which is shown in FIG. 7. Finally, the dried receiving substrate is transported by belt 38 and over platform 47 to output stack 64.

The first part of the path of the receiving substrate 20 in the embodiment of FIG. 7 is similar to the one in FIG. 6: from input stack 61 via input rollers 62 to alignment system 45; via belt 15 past first ink application means 11; via drying-transportation belt 14 through drying section 12. Then, however, the receiving substrate is transported by belt 29 along concave curve 37, substantially straight portion 38 and concave curve 39. Finally, the receiving substrate is transported along substantially straight portion 40 to output stack 64 or to alignment system 45, in case the second side of the receiving substrate has to be printed. Transporting the receiving substrate along concave curves 37 and 39 is no problem, since the receiving substrate is already dry. Narrow belts 17 at the unprinted side borders of the receiving substrate assist in transporting the receiving substrate along belt 29, in the transfer from printing-transportation belt 15 to drying-transportation belt 14, and may also be used in other places. These narrow belts are discussed below, at the discussion of transfer from one belt to another one.

In the embodiment of FIG. 7, the first path past the first ink application means and through the first drying section is identical to the second path past the second ink application means and through the second drying section, as opposed to the embodiments of FIGS. 1 to 6. Moreover, in the embodiment of FIG. 7, the first and the second ink application means are identical as well as the first and the second drying section.

Transfer of the receiving substrate from one belt to another one, for instance in FIG. 2 from vacuum belt 15 to vacuum belt 14, and also simply called "transfer" below, may be accomplished as follows.

Before disclosing transfer to another belt, first an embodiment of pulleys 13 is disclosed wherein the receiving substrate 20 is guided by vacuum along a curve, such as convex curve 31 in FIG. 1. The pulley 13 may include a set of thin, preferably identical, pulleys on a same shaft. Vacuum applicators, that are preferably stationary, may be located between the thin pulleys. Preferably each vacuum applicator is located between two thin pulleys, or, in another preferred embodiment, each thin pulley is located between two vacuum applicators. The thin pulleys guide belt 14 and receiving substrate 20 along the curve, while the vacuum applicators generate the vacuum that adheres the receiving substrate 20 to vacuum belt 14.

Transfer, for instance—when referring to FIG. 2—from belt 15 at pulley 13*c* to belt 14 at pulley 13*a*, may now be accomplished as follows. In a first preferred embodiment, vacuum applicators are used at thin pulleys 13*c* that generate a varying vacuum. The varying vacuum is preferably a controlled, weakening vacuum in the 'downstream' direction along pulley 13*c*, i.e. weakening towards pulley 13*a*. As an example, with $p_{ATM}$ representing the atmospheric pressure, the vacuum along the path of the receiving substrate along pulley 13*c* (i.e. along curve 31 shown in FIG. 1 and in the sense of arrow A1) may change from 50 mbar below $p_{ATM}$ to 20 mbar below $p_{ATM}$. Such a varying vacuum may be realised by vacuum applicators that have two or more portions, each with a different magnitude of the vacuum, along the curved path of the receiving substrate. Alternatively, constructional features of the vacuum applicators, such as their shape, the number of vacuum suction holes, etc. may change in the downstream direction of pulley 13*c* so that a varying vacuum is realised.

In another preferred embodiment, a mechanical releasing means such as a scraper is used to make the receiving substrate leave pulley 13*c*. In a more preferred embodiment, the receiving substrate is released from pulley 13*c* by pneumatic means, e.g. by blowing air against the receiving substrate. The vacuum applicator(s) at pulley 13*c* may be followed by a portion wherein the air pressure is larger than atmospheric pressure so that an air flow releases the receiving substrate from pulley 13*c*. A vacuum applicator applying either a constant or a varying vacuum may be combined with mechanical releasing means, with pneumatic releasing means, or with both. Additionally, a mechanical guiding means such as a guiding plate or guiding wires at the non-printed side of the receiving substrate may be used to assist the receiving substrate in bridging the gap between pulleys 13*c* and 13*a*. Instead of a mechanical guiding means, pneumatic guiding means such as air jets may be used; the air jets may arise from the exhaust, i.e. the high pressure side, of one or more vacuum applicators. If no ink is applied to the side borders of the receiving substrate, so that the receiving substrate has unprinted side borders in the transportation direction, additional side guiding means may be used. The side guiding means may include a narrow belt contacting the first unprinted border and a narrow belt contacting the second unprinted border of the receiving substrate; the narrow belts press the receiving substrate against the vacuum belt, e.g. along curve 31 in FIG. 1, and are driven at the same speed as the vacuum belt. FIG. 7 shows narrow belts 17 acting as side guiding means.

Preferably, the vacuum generated at pulley 13*a* is also a varying vacuum, becoming stronger in the sense of arrow A1 so that the receiving substrate is gradually more attracted by vacuum belt 14 in the transportation direction. In a preferred embodiment, printer 10 includes synchronising means for synchronising the transportation speeds of respectively belt 15 and belt 14. A synchronising means as known in the art may be used; it may include timing belts, encoders, controlling means. An advantage of speed synchronisation is that the transfer of the receiving substrate from belt 15 to belt 14 may be accomplished without or with only negligible speed difference of the belts, so that the forces during transfer on the receiving substrate and hence on the printed image are smaller; this is advantageous in obtaining high quality prints.

The form of the path section that is followed by the receiving substrate 20 at the transfer from one belt to another one matters greatly in avoiding or reducing shocks during transfer; this mainly applies to sheets, less to a continuous web. Especially the printing transportation means, such as belts 15 and 27 in FIG. 6, are preferably kept as free from shocks as possible, in order to obtain high quality prints. An example of transfer along a substantially straight portion of the path of the receiving substrate is, in FIG. 5, portion 30 for transfer from the first printing-transportation belt 15 to the first drying-transportation belt 14. We have found that transfer along a path section that includes a curve is more advantageous with respect to reducing shocks than transfer along a substantially straight portion. An example of a path section including a curve is shown in FIG. 6, between the first printing-transportation belt 15 and the first drying-transportation belt 14: the receiving substrate follows a path along convex curve 31, portion 41 and concave curve 42 (both indicated by a dashed line) and substantially straight portion 32*a*.

We have found that transfer from a first to a second belt along a substantially straight portion of the path may cause shocks, that originate mainly from buckling of the receiving substrate. A first possible cause of these shocks is an alignment error of e.g. the belts, so that, as shown in FIG. 4, at the transfer from belt 28 to belt 27, the path of the receiving substrate is not along arrow c1 but along arrow c2 (for clarity, the deviation of arrow c2 from arrow c1 is overexaggerated in FIG. 4). Thus, the front end (or tip) of the receiving substrate slightly collides with belt 27, which may cause buckling in the receiving substrate and thus generate a shock that is transmitted to belt 27. Another possible cause of shocks is a speed difference between the first and the second belt, which may cause either buckling in the receiving substrate (in case the second belt is slower) or a tensile force on the receiving substrate (in case the second belt is faster), and which may hence cause shocks. We have found that speed differences, alignment errors and other possible causes of shocks are much better counteracted by a curved receiving substrate, i.e. by a receiving substrate that is already bent. This applies to causes of shocks related to the front end of the receiving substrate touching the second belt; it also applies to causes of shocks at another moment, such as belt speed differences when the receiving substrate is being transported by both belts at a time. Thus, the path of the receiving substrate at the transfer preferably includes a curve.

A first embodiment of such a path is shown in FIG. 2, at the transfer from belt 15 to belt 14, where the path includes a convex curve along pulley 13*c*. A second embodiment, preferred to the first one, is in FIG. 6: path 31,41,42,32*a* which was mentioned already above. Portion 41 may be substantially straight, convex or concave, or a combination of these, depending a.o. upon the stiffness of the receiving substrate and the guiding means—if present—used at the transfer. Curve 42 is concave; this does not represent a problem since the printed side of the receiving substrate is not touched by e.g. a roller. The receiving substrate is already bent because of curve 31; because of concave curve 42, the receiving substrate is bent additionally near belt 14. In FIG. 6, convex curve 31 covers an angle that is preferably larger than 90° and smaller than 120°, more preferably larger than 100° and smaller than 115°. The angle covered by curve 31 is determined by the extension of the concerned vacuum applicator. Further, the path of the receiving substrate during transfer, as shown in FIG. 6 by a dashed line, preferably makes an angle $\alpha$ with portion 32*a* along belt 14, that satisfies the following relation:

$\alpha$ is preferably larger than 0° and smaller than 30°, more preferably larger than 10° and smaller than 25° (1).

Factors determining the angle $\alpha$ are the relative position of belt 15 with respect to belt 14, the angle covered by curve 31, the extent of the vacuum applicators along belt 14. A third embodiment of a path including a curve at transfer is shown in FIG. 6 at the transfer from belt 27 to belt 24. As in the second embodiment (i.e. path 31,41,42,32*a*), the path of the receiving substrate during transfer makes an angle $\alpha$ with portion 52 along belt 24, with $\alpha$ preferably satisfying relation (1). The path also includes a concave curve located directly upstream of substantially straight portion 52. The difference of this third embodiment with the second one is the much smaller angle along the pulley of belt 27 that immediately precedes the transfer. The angle along the concerned pulley of belt 27 may be e.g. 15°, while the angle along curve 31 is more than 90° in the second embodiment. If the largest portion of the path during transfer from belt 27 to belt 24 is substantially straight, as shown by the dashed line in FIG. 6, then the angle along the concerned pulley of belt 27 is about $\alpha$ degrees, with $\alpha$ the angle mentioned above in connection with relation (1).

Transfer at a path section that includes a curve may be combined with means as described above in the discussion of transfer from one belt to another one: speed synchronising means, a varying vacuum, pneumatic releasing means, mechanical releasing means, pneumatic guiding means, mechanical guiding means, mechanical (side) guiding means.

A transfer method preferably includes the steps of transporting the receiving substrate along a curve, preferably synchronising speeds, optionally supplying a varying vacuum, preferably releasing the receiving substrate pneumatically, optionally releasing the receiving substrate mechanically, for instance by a scraper, optionally guiding the receiving substrate mechanically and/or pneumatically.

An advantage of the invention is that ink may be applied along a substantially horizontal or along a substantially vertical portion of the path of the receiving substrate. This is applicable to carriage-type printers and to page-width type printers. The ink application means 11, 21 shown in FIGS.

1 to 7 may extend along a rather long portion of the path, of the order of several hundreds of mm for instance, since inks of a plurality of colours may be applied successively to the receiving substrate. A portion is substantially horizontal if, for each pair of points A, B belonging to the portion, the straight line segment AB between A and B makes an angle $\gamma$ with a horizontal plane so that the absolute value of the angle $|\gamma|$ is not larger than 20°, preferably smaller than 15°, more preferably smaller than 10°, even more preferably smaller than 5° and most preferably smaller than 3°. A portion is substantially vertical if, for each pair of points C, D belonging to the portion, the straight line segment CD between C and D makes an angle $\delta$ with a vertical plane so that the absolute value of the angle $|\delta|$ is not larger than 20°, preferably smaller than 15°, more preferably smaller than 10°, even more preferably smaller than 5° and most preferably smaller than 3°.

In the embodiments shown in FIGS. 1–3 and FIGS. 5–7, ink is applied along substantially vertical portions of the path (in FIG. 1: portions 30 and 52), while FIG. 4 shows that ink is applied by ink application means 11 and 21 along substantially horizontal portions of the path. An advantage of applying ink along a substantially horizontal portion is that the conditions with respect to gravity are the same for all portions of the ink application means; for ink-jet for instance, all nozzles may be fed with liquid ink at the same head, i.e. at the same pressure. On the other hand, ink application along a substantially vertical portion is very advantageous with respect to maintenance and reliability, as explained below.

With respect to maintenance, when withdrawing the ink application means from the printer, for instance sideways, the ink application means are easily accessible by an operator for cleaning purposes etc. In case of ink application along a substantially horizontal portion, such as in FIG. 4, accessibility is not so good since, after sideways withdrawal of the ink application means from the printer, the operator has to crawl under ink application means 21 resp. 11; the height of the printer in FIG. 4 is typically about 2 m so that ink application means 21 is at a height of only about 1 m. Maintenance of ink application means for liquid ink is important for a carriage-type printer and for a page-width type printer; it is discussed in U.S. Pat. No. 5,717,446.

With respect to reliability, ink application along a substantially vertical portion is advantageous since accidentally dropped ink is not harmful to quality. When ink drops accidentally from the application means, for instance because of a leakage, such ink will drop downwards, so that it will not drop onto the receiving substrate and it will not drop back onto the ink application means either.

Therefore, in a preferred embodiment, ink is applied along a substantially horizontal portion of the path of the receiving substrate; in a more preferred embodiment, ink is applied along a substantially vertical portion.

Preferably, the so-called 'throw-distance', is kept constant. The 'throw-distance' is the distance that the ink has to travel between the ink application means, for instance an ink-jet nozzle, and the receiving substrate. When using a belt, such as belt 14 in FIG. 1, to transport the receiving substrate 20 past the ink application means 11, belt 14 may move slightly towards or away from the ink application means 11 during the ink application, due to disturbances. This may cause the throw-distance to change in time, which may result in lower print quality. Therefore, in a preferred embodiment, printer 10 comprises additional guiding means (not shown in FIG. 1) for guiding belt 14 at the location where ink is applied onto the receiving substrate, i.e. facing the ink-jet nozzles in case of an ink-jet printer. The additional guiding means may include a small roller with an axis substantially parallel to the axis of pulleys 13 in FIG. 1, or it may include another kind of rotatable member. Preferably, means are provided to tighten the belt and to ensure that the belt contacts the additional guiding means. Preferably, the additional guiding means guides the belt over a small convex arc covering an angle of e.g. 1° to 5°, or even smaller than 1°. In a first embodiment, the tightening means are the vacuum applicators themselves; a first vacuum applicator is located downstream and adjacent to the additional guiding means and a second vacuum applicator is located upstream and adjacent to the additional guiding means; the forces exerted by both vacuum applicators on the belt tighten the belt against the additional guiding means. In a second embodiment, the tightening means may be located anywhere along the belt and provide an adequate belt tension in the complete belt, while the additional guiding means have protruding positions, as explained below, to ensure contact between the belt and the additional guiding means. Suppose, for example, that in FIG. 1 four types of ink are applied to the receiving substrate at respectively positions i1,i2,i3,i4. Belt 14 is then guided by additional guiding means so that it contacts these additional guiding means in respectively i1, i2, i3, i4; preferably the contact is over a small convex arc, as in the first embodiment. As shown in FIG. 1, greatly exaggerated for clarity, the additional guiding means at i1 and i4 protrude with respect to the straight line between P1 and P2, while i2 and i3 protrude with respect to the straight line between i1 and i4. Preferably, the means to apply the four types of ink—the nozzles in case of ink-jet—are all at the same distance from the belt, so that the same throw-distance is used for all the inks; thus, in the case of positions i1–i4 in FIG. 1, the nozzles are not in the same vertical plane but they follow the protrusions of the belt at a given distance, i.e. the throw-distance. As mentioned above, the protruding distances in FIG. 1 are overexaggerated; in reality, at the scale at which FIG. 1 is drawn, i1 to i4 would not visibly or nearly not visibly deviate from the straight line between P1 and P2. This second embodiment may be combined with the first one, i.e. vacuum applicators may be used to tighten the belt in the second embodiment.

In another embodiment, the additional guiding means guides the belt over a convex curve, covering an angle of e.g. 10° or 20°, instead of over a small convex arc. The same tightening means as described above may be used. In this embodiment, the ink application means 11 preferably apply ink along a path comprising substantially straight portions and convex curves—not along a substantially straight portion as shown in FIGS. 1 to 7.

A method to keep the throw-distance constant preferably includes the step of guiding the belt during ink application over a small convex arc, covering an angle of e.g. 1° to 5°, or even smaller than 1°. Keeping the throw-distance constant is applicable to carriage-type printers and to page-width type printers.

A duplex printer in accordance with the invention preferably includes a take-over section 25 wherein the receiving substrate 20 is transferred from the first path 30–36 to the second path 50–59; a first image is printed on the first side of the receiving substrate along the first path 30–36 and a second image is printed on the other side of the receiving substrate along the second path 50–59. In a preferred embodiment, this transfer of the receiving substrate is carried out 'on the fly', i.e. while the transport of the receiving substrate is being continued in the same sense as before the transfer. An advantage is speed: transfer on the fly is much faster than stopping the transport in order to swap the printed side and the opposite side of the receiving substrate, which may include reverting the travelling sense of the receiving substrate. Take-over sections 25 with transfer 'on the fly' are shown in FIGS. 1 to 6, while FIG. 7 shows a take-over section 25 wherein transport of the receiving substrate 20 is stopped and the travelling sense is reverted.

FIG. 1 shows a take-over section wherein the receiving substrate 20 is transferred from belt 14 to belt 24. In take-over section 25, substantially straight portion 36*a*,36*b* of path 30–36 and substantially straight portion 50 of path 50–59 are preferably substantially parallel. In a first embodiment, the maximum distance between these two substantially straight portions 36*a*,36*b* and 50 is smaller than k*d wherein d is the thickness of the receiving substrate (e.g. d=0.1 mm) and with k a constant that is not larger than 200, preferably smaller than 50, more preferably smaller than 20, even more preferably smaller than 10 and most preferably smaller than 5. An advantage of a small distance d is that the transfer from portion 36*a*,36*b* to portion 50 may be fast and also easier to carry out at high transportation speeds as will become clear from the explanation below. In a second embodiment, the maximum distance between the two substantially straight portions 36*a*,36*b* and 50 is preferably smaller than 100 mm and more preferably approximately 30 mm; in this embodiment, preferably mechanical side guiding means or mechanical guiding means are used as discussed below, in connection with the take-over section shown in FIG. 6.

Preferably, printer 10 includes synchronising means for synchronising the transportation speeds of respectively the first transportation means 13,14 and the second transportation means 23,24. A synchronising means as known in the art may be used; it may include timing belts, encoders, controlling means. An advantage of speed synchronisation is that transfer from the first path 30–36 to the second path 50–59 may be accomplished without or with only negligible slip, i.e. speed difference, of the transportation means with respect to each other. In case of vacuum belts, the receiving substrate is transferred in FIG. 1 from vacuum belt 14 to vacuum belt 24. A smaller slip means that the receiving substrate is transferred in the take-over section 25 from vacuum belt 14 to vacuum belt 24 with smaller tangential forces on the receiving substrate and hence on the printed image; this is advantageous in obtaining high quality prints.

In a third embodiment, the receiving substrate 20 is transferred from belt 14 to belt 24 as shown in FIG. 1 and the distance between the two substantially straight portions 36*a*,36*b* and 50 is substantially zero so that, in case of vacuum belts, vacuum belts 14 and 24 may make contact with each other in the take-over section 25. Preferably, the length of the contact zone is approximately 10 cm.

In case of vacuum belts, preferably, a varying vacuum in the travelling direction of the receiving substrate assists in the transfer. This varying vacuum may be obtained by weakening the vacuum in the sense of arrow A1 (see FIG. 1) along substantially straight portion 36*a*,36*b*; this vacuum is generated by one or more vacuum applicators (not shown in FIG. 1) of vacuum belt 14. Pneumatic releasing means, such as one or more air jets that preferably blow substantially perpendicular to portion 50 and towards portion 50 may assist in the transfer; the air jets may arise from the exhaust, i.e. the high pressure side, of one or more vacuum applicators. Preferably, one or more vacuum applicators of vacuum belt 24 generate a varying vacuum, strengthening in the sense of arrow A2 along portion 50; more preferably both the vacuum along portion 36*a*,36*b* and along portion 50 are varying.

FIG. 6 shows a take-over section 25 wherein the receiving substrate 20 is transferred from belt 14 to roller 16. In a preferred embodiment, the distance from the outer surface of roller 16, at position P7, to belt 14 is substantially equal to the thickness of the receiving substrate 20. In another preferred embodiment, this distance is larger, but preferably smaller than 20 mm. We have found that having a larger distance is more advantageous in order to reduce shocks during take-over of the receiving substrate. A possible cause of shocks is a speed difference between belt 14 and roller 16 (even if a synchronising means is used, a speed difference, albeit small, may exist). In yet another preferred embodiment, mechanical side guiding means are used such as the narrow belts 17, discussed above at the discussion of transfer from one belt to another one and shown in FIG. 6; the position of the narrow belts at roller 16 in FIG. 6 is preferably similar to the position of narrow belts 17 at curve 37 in FIG. 7. To provide space for these narrow belts and for the pulleys guiding them, the distance between the outer surface of roller 16, at position P7, and belt 14 is preferably smaller than 100 mm and more preferably approximately 30 mm. Preferably only mechanical side guiding means are used; in another embodiment, however, mechanical guiding means are used that also contact the central portion of the receiving substrate, i.e. the portion located between the sides of the receiving substrate. An example of such mechanical guiding means are narrow belts having a width of 15 mm that are spaced apart 70 mm over the complete width of the receiving substrate (remark: the width is the dimension substantially perpendicular to the transportation direction). The mechanical (side) guiding means contact the receiving substrate 20 at its side opposite the printed side.

Moreover, in the embodiments of the take-over section discussed in connection with FIG. 6, synchronising means, a constant or a varying vacuum, pneumatic releasing means may-be used as explained in the discussion of the take-over section embodiments of FIG. 1. Furthermore, both in the take-over sections of FIG. 1 and of FIG. 6, a mechanical releasing means may be used such as a scraper.

After the take-over section, the receiving substrate is preferably aligned so that the receiving substrate will have its desired position when ink is applied on its second side by ink application means 21. This may be done by alignment system 46, shown in FIG. 6. Alignment systems 45 and 46 may comprise, as known in the art, a belt that is arranged obliquely under an angle of e.g. 15° with the transportation direction of the receiving substrate. The receiving substrate is pushed by the oblique belt against a guiding element that has a fixed, known position so that the receiving substrate is aligned with this guiding element. A set of balls press the receiving substrate upon the belt. Preferably, also in the embodiments of the printer shown in FIGS. 1 to 5 alignment systems are used before ink is applied to the receiving substrate, by ink application means 11 and 21.

A take-over method preferably includes the steps of synchronising speeds, preferably weakening the vacuum (in the embodiment shown in FIG. 1: along portion 36*a*,36*b*), optionally blowing air, for instance by an air jet, optionally releasing the receiving substrate mechanically, preferably strengthening the vacuum (in the embodiment shown in FIG. 1: along portion 50).

Although the invention is described above mainly with respect to a receiving substrate in the form of separate sheets, the invention may also be applied for printing onto a continuous web. An advantage of the invention is that it may both be applied to separate sheets and to a continuous web. To print onto a continuous web, the input stack 61 has to be replaced by an input roll of receiving substrate. At the output side of the printer, the printed continuous web may be cut into sheets that are stacked or the printed web may be wound upon an output roll. In case of a continuous web, the transportation means 13,14,15 and 23,24,26 may assist in 'auto-loading' the web, i.e. in automatically loading the starting end of a new roll of receiving substrate into the printer. An advantage is that no or nearly no receiving substrate is lost: images may already be printed near the starting end of the web.

The portion of the printer that is used to print on the first side of the receiving substrate may be nearly identical to the portion of the printer for printing on the opposite side of the receiving substrate; see e.g. FIGS. 1 and 2. Many mechanical parts of both portions may be identical, which has the advantage of lowering production costs. Moreover, the distance and the conditions that are used to dry the receiving substrate may be nearly the same in both portions of the printer; this is advantageous in obtaining the same high quality of the images printed on both sides of the receiving substrate.

Having described in detail preferred embodiments of the current invention, it will now be apparent to those skilled in the art that numerous modifications can be made therein without departing from the scope of the invention as defined in the appending claims.

LIST OF REFERENCE SIGNS

10: printing apparatus
11: ink application means
12: drying section
13: pulley
14: belt
15: belt
16: roller
17: narrow-belt
20: receiving substrate
21: ink application means
23: pulley
24: belt
25: take-over section
26: roller
27: belt
28: belt
29: belt
30,32,34,36,38,40: substantially straight portion
31,33,35,37,39: curve
41: portion
42: curve
45: alignment system
46: alignment system
47: platform
50,52,54,56,58: substantially straight portion
51,53,55,57,59: curve
61: input stack
62: input rollers
63: output rollers
64: output stack
p1,p2,p3,p4,p5,p6,p7: position
i1,i2,i3,i4: position
A1,A2: arrow
b1,b2,b3: arrow
c1,c2: arrow

The invention claimed is:

1. A method for producing an image on a receiving substrate in a printing apparatus, comprising the steps of:

a. imagewise applying liquid ink to a first side of the receiving substrate using a noncontact inkjet printing head while transporting the receiving substrate along a first substantially straight portion;

b. subsequently transporting the receiving substrate along a first convex curve adjacent said first substantially straight portion while actively drying the receiving substrate;

c. subsequently transporting the receiving substrate along a second substantially straight portion;

d. subsequently transporting the receiving substrate along a second convex curve while actively drying the receiving substrate.

2. A method according to claim 1, wherein the step of transporting the receiving substrate along the second substantially straight portion further comprises active drying of the receiving substrate.

3. A method for producing an image on a receiving substrate in a printing apparatus, comprising the steps of:

a. imagewise applying liquid ink to a first side of the receiving substrate while transporting the receiving substrate along a first substantially straight portion;

b. subsequently transporting the receiving substrate along a first convex curve while actively drying the receiving substrate;

c. imagewise applying liquid ink to a second side of the receiving substrate opposite to said first side while transporting the receiving substrate along a second substantially straight portion;

d. subsequently transporting the receiving substrate along a second convex curve while actively drying the receiving substrate;

e. subsequently transporting the receiving substrate along a third substantially straight portion;

f. subsequently transporting the receiving substrate along a third convex curve while actively drying the receiving substrate.

4. A method according to claim 3, wherein the step of transporting the receiving substrate along the third substantially straight portion further comprises active drying of the receiving substrate.

* * * * *